US008777781B2

(12) United States Patent
Marks et al.

(10) Patent No.: US 8,777,781 B2
(45) Date of Patent: Jul. 15, 2014

(54) VARIABLE GRAVITY TRAINING DEVICE

(71) Applicant: Variable Gravity Patents, LLC, Falmouth, ME (US)

(72) Inventors: Michael A Marks, Falmouth, ME (US); Steven Leen, Cumberland Center, ME (US)

(73) Assignee: Variable Gravity Patents, LLC, Falmouth, ME (US)

( * ) Notice: Subject to any disclaimer, the term of this patent is extended or adjusted under 35 U.S.C. 154(b) by 48 days.

(21) Appl. No.: 13/973,604

(22) Filed: Aug. 22, 2013

(65) Prior Publication Data

US 2013/0337945 A1 Dec. 19, 2013

Related U.S. Application Data

(63) Continuation of application No. PCT/US2012/056094, filed on Sep. 19, 2012.

(60) Provisional application No. 61/536,845, filed on Sep. 20, 2011.

(51) Int. Cl.
*A63B 69/00* (2006.01)

(52) U.S. Cl.
USPC ..... 473/429; 473/420; 473/446

(58) Field of Classification Search
USPC ..... 473/420, 423, 424, 427, 429, 430, 438, 473/446, 447, 451, 459
See application file for complete search history.

(56) References Cited

U.S. PATENT DOCUMENTS

| | | | | | |
|---|---|---|---|---|---|
| 2,633,320 | A | * | 3/1953 | Salmi | 248/123.2 |
| 3,498,613 | A | * | 3/1970 | Dreyer | 473/575 |
| 3,904,203 | A | * | 9/1975 | Matsumoto | 273/317.4 |
| 4,042,237 | A | * | 8/1977 | Moraru | 473/429 |
| 4,105,203 | A | * | 8/1978 | Cho | 473/429 |
| 4,173,340 | A | * | 11/1979 | Kanno | 473/575 |
| 4,307,888 | A | * | 12/1981 | Ohle | 473/429 |
| 4,460,172 | A | * | 7/1984 | Hogan | 473/426 |
| 4,462,599 | A | * | 7/1984 | Brown | 473/430 |
| 4,516,769 | A | * | 5/1985 | Kopp | 473/423 |
| 4,561,661 | A | | 12/1985 | Walker | |
| 4,576,379 | A | * | 3/1986 | Juhasz | 473/430 |
| 4,616,834 | A | * | 10/1986 | Davis | 473/429 |
| 4,720,095 | A | | 1/1988 | Sowards | |
| 5,037,113 | A | * | 8/1991 | Sowards | 473/423 |
| 5,553,848 | A | * | 9/1996 | Amron | 473/416 |
| 5,605,326 | A | * | 2/1997 | Spear, Jr. | 473/422 |

(Continued)

FOREIGN PATENT DOCUMENTS

| | | | |
|---|---|---|---|
| DE | 3232323 | A1 | 3/1984 |
| GB | 2423722 | B | 8/2007 |
| GB | 2447732 | A | 9/2008 |

*Primary Examiner* — Mark Graham
(74) *Attorney, Agent, or Firm* — Patricia M. Mathers

(57) ABSTRACT

A variable gravity training device allows a user to train skills in controlling a sports device. The training device has a stationary base, a movable support bar, and a sports device, for example, a ball, a badminton birdie, or a volley ball affixed to the end of the bar. The support bar is weighted, so that the amount of force required to move the sports device is reduced. The weighted bar also reduces the speed with which the sports device returns to its home position. The force adjustment means is adjustable, so that, with training, weights may be removed, so that the conditions governing the sports device correspond to real playing conditions.

11 Claims, 6 Drawing Sheets

(56) References Cited

U.S. PATENT DOCUMENTS

| | | | | |
|---|---|---|---|---|
| 5,618,039 | A * | 4/1997 | Tsai et al. | 473/423 |
| 5,951,414 | A * | 9/1999 | Sowards | 473/423 |
| 5,957,789 | A * | 9/1999 | Ainscough et al. | 473/423 |
| 6,296,582 | B1 * | 10/2001 | Minniear | 473/428 |
| 7,186,192 | B1 * | 3/2007 | Suissa | 473/423 |
| 7,811,183 | B1 | 10/2010 | Ohle | |
| 8,262,516 | B2 * | 9/2012 | Fuentes | 473/429 |
| 2002/0028716 | A1 * | 3/2002 | Gormley | 473/423 |
| 2008/0280702 | A1 * | 11/2008 | Ohle | 473/423 |
| 2009/0286630 | A1 * | 11/2009 | Aguirre | 473/420 |
| 2013/0053188 | A1 * | 2/2013 | Moore | 473/423 |

* cited by examiner

VARIABLE GRAVITY TRAINING DEVICE

FIELD OF THE INVENTION

The invention relates to a sports training device. More particularly, the invention relates to a device for training gross motor skills.

BACKGROUND INFORMATION

Athletes need to develop their gross motor skills, such as, for example, good eye-to-hand or eye-to-foot coordination, in order to excel at a particular sport or athletic activity. For example, soccer players spend many hours juggling a soccer ball, to train the coordination between the eye and foot and leg. The difficulty with this type of training is that the goal is to kick or juggle the ball as much as possible, but a person actually spends the greater portion of training time chasing and retrieving the ball. The same difficulty arises when training for various other ball sports.

What is needed, therefore, is a training device that enables a person to train gross motor skills by repeatedly engaging with a sports device, such as a ball, without having to spend time retrieving the sport device. What is further needed is such a device that is adaptable to the skill level of the trainee.

BRIEF SUMMARY OF THE INVENTION

The invention is a training device that enables a person to repeatedly attack or engage a sports device, for the purpose of training motor skills. The embodiment described herein shows the training device used with a sports device that is a soccer ball. It is understood, however, that the training device is a versatile device and may also be used for training in any number of other sports. Examples of such other sports are volleyball, tennis, baseball, badminton, basketball, golf, rugby, football, cricket, table tennis, lacrosse, field hockey, ice hockey, fencing, softball, weightlifting, boxing, etc., as well as physical therapy exercises. These are merely examples and, as such, are not intended to be limiting. The term "ball" is used hereinafter interchangeably with the term "sports device," to refer to the sport article that is supported on the training device, but it is understood that "ball" as used herein includes other types of sports devices, such as badminton birdies, hockey pucks, etc.

The training device according to the invention has a stationary base and a support means for supporting the sports device. The support means is pivotable, which allows the user to engage the sports device from many different angles and directions. The support means includes a force-adjusting means that allows adjustment of the force required to move the ball and the speed with which the ball returns to a home position, so as to accommodate the specific skill level of the user. For example, for a beginner, it may be desirable to require a smaller force to move the ball and a slower return to the starting position. For an advanced user, it is, of course, desirable that normal force be required to move the ball and that the ball return to the home position at normal velocity as determined by the normal force of gravity.

Using the example of practicing juggling a soccer ball, i.e., using the foot to move or control the ball, the stationary base is placed on the floor or ground. A soccer ball is secured at the operating end of the support means and is held by the support means in a home position. Depending on the particular sport, the home position for the sport device may be on the ground, or, for example, in the case of a training device for volleyball, a certain distance above the ground. The force-adjusting means is adjusted to accommodate the skill level of the user. The user now engages the ball. The support means will deflect in response to the angle of attack. Depending on the particular sport that is the object of the training, the ball may be coupled with the support means in a manner that will allow the ball to spin, so that the user may practice not only moving the ball with a particular part of the body or in a particular direction, but also applying a spin to the ball, because spin may provide important feedback to the user, as to proper operation or procedure. The force adjustment means controls the amount of force needed to move the ball and the speed with which it returns to the home position. For a beginner, the force adjustment means is set so that less force is required to move the ball and the ball returns to the home position slower than would be the case on the playing field. In the case of an advanced player, the force adjustment means is set so that the ball reacts as it would under normal playing conditions, that is, normal force is required to move the ball and the ball returns to the home position at normal speed, i.e., under the normal force of gravity.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
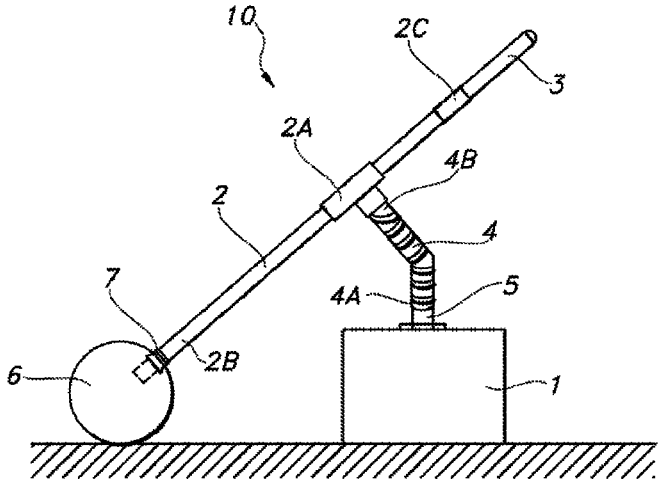
FIG. 1 is a side elevation view of a schematic illustration of the variable gravity training device according to the invention, first embodiment.

FIG. 1 illustrates a first embodiment of a training device 10 according to the invention. In the embodiment shown, the intended purpose of the training device 10 is to allow a user to practice juggling a soccer ball, without having to chase after the ball each time the ball is engaged. The ball is shown in a home position, which, in this case, is at a particular location on the ground or floor. The training device may be used for other training purposes, which shall be described below, but for purposes of illustration, it shall be assumed that the training is for soccer and the sports device shall be referred to as a "ball".

The training device 10 has an anchor means or stationary base 1, an adjustable support means 2 to which a sports device 6, i.e., the ball, is affixed, and a force adjustment means 3 that controls the force needed to move the sports device and also the speed with which the sports device returns to a home position. The support means 2 is coupled to the base by means of a flexible connector 4 that has a first end 4A that is coupled to the stationary base 1 and a second end 4B that is affixed to the support means 2. The flexible connector 4 allows the support means to move in the direction of a force applied to it and then for the support means to return to its home position.

In this embodiment the stationary base 1 is a weighted base, for example, a container filled with water, and the flexible connector 4 is a spring that is attached to the stationary base 1. The home position is a specific position relative to the stationary base 1, with regard to both a vertical and a horizontal distance from the stationary base 1. The spring, having a specific rest position, repeatedly brings the ball back to the same spot, i.e., to its home position. Thus, for example, if the home position for the soccer ball shown in FIG. 1 is at a particular spot on the ground, the flexible connector 4 will return the operative end of the support means 2 back to its home position. If the training device 1 is adapted for volleyball training, on the other hand, the support means 2 is adjusted so that the home position is a suitable distance above the ground.

Other types of suitable flexible connectors include ball joints, universal joints, solid rubber joints, flexible polymeric joints, etc. It may be desirable to have the ball return to the same vertical distance relative the base 1, but not necessarily to the same radial position. For example, if multiple users are training together, it may be desirable to have the sports device fall back to the same vertical distance, but also travel around the base to be engaged by another user at a different radial position. Depending on the type of flexible connector used, the "home position" may then refer simply to a predetermined vertical position, but not necessarily to a predetermined radial position relative to the stationary base 1.

The force level of the training device 10 is adjustable, to adapt the device to the specific training needs of the user. For example, it may be desirable to slow down the return of the sports device to its home position and also to reduce the amount of force required to move the sports device, to allow beginners with lower muscle strength and less developed motor skills to practice at a slower than normal speed. The force-adjusting means 3 is an adjustable mechanism that changes the force of gravity acting on the sports device, hence, the term "variable gravity training device," and thereby reduces the amount of force required to move the ball and slows down the return of the ball to its home position. The user or coach is able to adjust the training device 10 to accommodate the specific training needs of the user.

In the embodiment shown in FIG. 1, the support means 2 is a rigid bar that extends through a connector 2A that couples the bar with the flexible connector 4 and has a first end 2C and a second end 2B. The force-adjusting means 3 is a bar that is slidably captured in the second end 2B of the rigid bar 2. When extended fully from the connector 2A, the force-adjusting means 3 applies a counterweight to the sports device 6, with the result that minimal kick force is required to move the ball upwards, and the fall of the ball to the home position is slowed down. In this position, the training device 10 is used to train a person of low muscle strength and/or poor motor skills. Pushing the bar into the support means 2 diminishes the force of the counterweight incrementally, corresponding to the change in the length of the bar that extends from the support means and correspondingly increases the amount of force required to kick the ball upward and the speed of the ball's return to the home position. The force-adjusting means 3 and the support means 2 are dimensioned such, that the force-adjusting means 3, when pushed in fully, does not extend past the connector 2A, that is, remains on the counterweight side of the pivot point of the support means. When pushed in fully, the support means 2 is balanced such, that the force-adjusting means 3 has no effect on the gravitational force acting on the ball, so that the normal free fall of the ball is the standard average of 9.81 $m/s^2$, suitable for training a person of intermediate or advanced skill. In the embodiment shown in FIG. 1, the training device 10 is constructed such, that, when the greatest counterweight is exerted on the support means, the balance point of the support means 2 together with the sports device 6 is at the location where the support means is coupled to the flexible connector 4. In other words, when the force-adjusting means 3 is fully extended out from the support means 2, the bar of the support means 2 is balanced on the end of the flexible connector 4 and held in a substantially horizontal plane. The balance point of the support means 2 may be varied, depending on the weight of the support means 2 and the force-adjusting means 3. It may be desirable, for example, to construct the support means 2 such that, when the force-adjusting means is fully extended, the sports device is held just a few inches above the ground.

Figure 2:
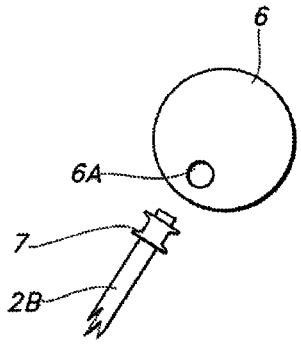
FIG. 2 illustrates a first embodiment of a sports device connector for coupling a ball to the training device.

FIG. 2 illustrates one means of coupling the sports device 6 with the support means 2. A coupling device 7 is mounted on the second end 2B of the support means 2. In the embodiment shown, the sports device is a soccer ball with an opening 6A. The coupling device 7 is a sleeve that is secured on the support means 2, adhesively or by other mechanical means. The sleeve has an inner collar and an outer collar, preferably of rubber or some other suitably flexible material. The coupling device 7 is inserted into the opening 6A, so that the inner collar snaps into place behind the edge of the opening, capturing the ball between the inner and outer collars. Preferably, the coupling device 7 is constructed to allow the ball to spin on it when a torque is exerted on the ball 6. One ball that is suitable for use with the training device 1 according to the invention is a soccer ball having a hollow core and hollow foam hole pattern, made by Champion Sports and sold under the brand name RHINO SKIN. A plurality of holes are already provided in the ball and the coupling device 7 may be sized so that the inner collar snaps into place in one of the holes. The training device 1 is, of course, not limited to use with this particular soccer ball. Any ball that can be adapted to be secured on the end of the support means may be used. Many different means and methods may also be used to couple the sports device 6 to the support means 2. For example, instead of the coupler 7 shown in FIG. 2, two openings or connectors may be provided on the sports device, diametrically opposed to each other. A forked bracket with two connecting arms affixed to the end 2B of the support means couples with the openings or connectors, thereby holding it in position on the support means. The sports device 6 may be spinnably or fixedly mounted on the support means 2, depending on its intended use. The sports device may also be coupled to the support means by means of a hinged connection, such that the sports device is suspended from the support means 2. A person of skill in the art will understand that the particular coupling means may vary according to the type of sports device being used or a particular effect that is desired.

Figure 3:
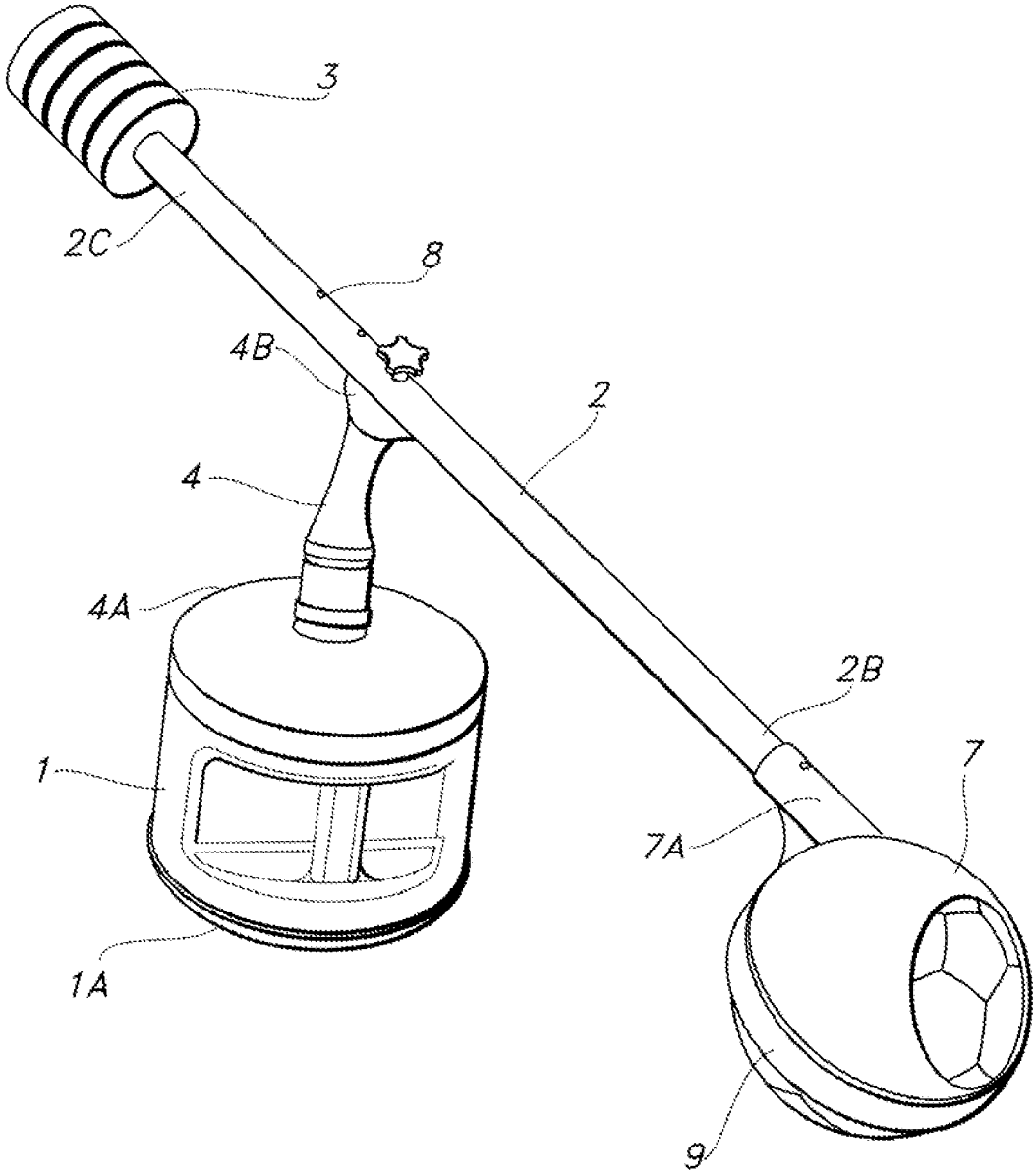
FIG. 3 illustrates a second embodiment of the variable gravity training device.

FIGS. 3-6 illustrate a second embodiment of the variable gravity training device 10. As shown in FIG. 3, the support means 2 is a tube with length-adjustment through-bores 8. The upper end 4B of the flexible connector 4 has a groove 4C that is dimensioned to cradle the support means 2. A threaded bolt is provided in the upper end of the connector 4 and extends up through the length-adjustment through-bores 8 on the support means 2. A knob 4D screws onto the bolt, to secure the support means 2 to the flexible connector 4. The lower end 4A of the flexible connector 4 is formed to fit over a connector on the upper side of the base 1. This lower end has a tessellated edge with tabs that splays out over the upper surface of the base 1. The body of the flexible connector is constructed of a polymeric, rubber-like material that allows the connector to flex in any horizontal direction and to return to its home position, thus allowing the sports device or ball to move in the direction of the force applied by the trainee and to return to the home position. A suitable material for the flexible connector is a thermoplastic elastomer (TPE), such as the styrene ethylbutylene styrene (SEBS) material sold under the brand name SUPERTOUGH.

Figure 4:
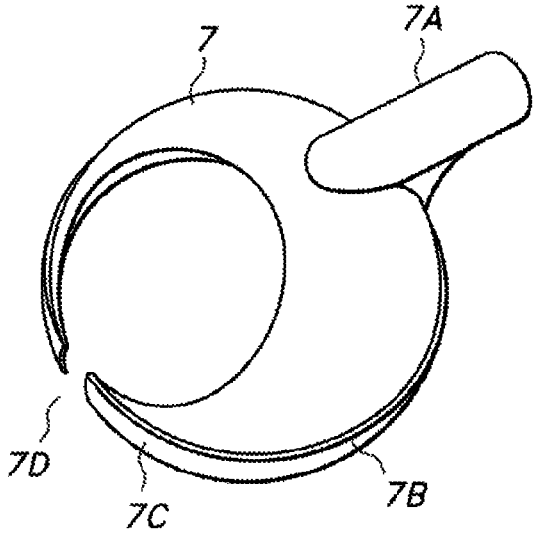
FIG. 4 illustrates a second embodiment of the sports device connector.
Figure 6:
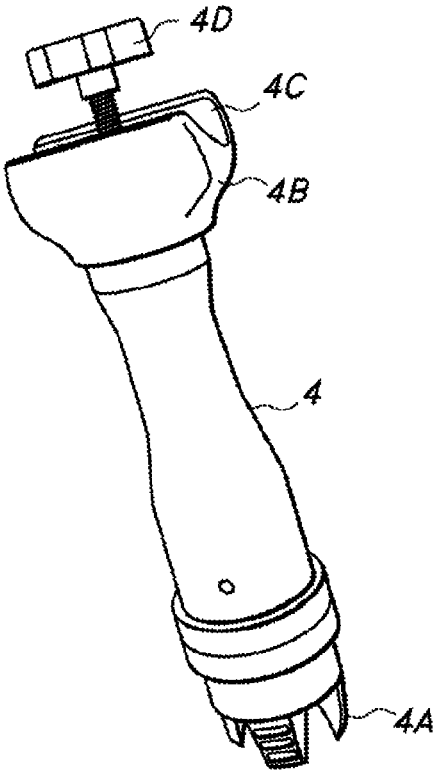
FIG. 6 shows a second embodiment of a flexible connector.
Figure 5:
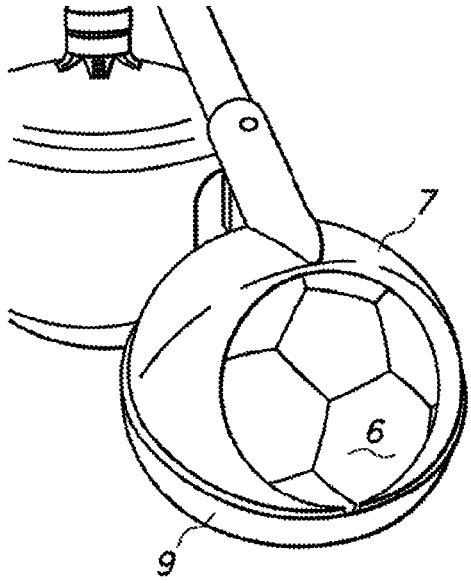
FIG. 5 illustrates the sports device connector with ball inserted and retainer band in place.

The coupling device 7 is a preformed hollow body 7B having a connector tube 7A. As seen in FIG. 4, the body 7B for this embodiment, i.e., for use with a soccer ball, is a partial sphere. A reinforced, slightly flexible lower edge 7C closes around the ball 6. The body extends more than halfway down over the ball, so that the lower edge is smaller in diameter than the diameter of the ball. Soccer balls come in various sizes and a break 7D allows the lower edge 7C to flex to accommodate balls of various sizes. A retainer band 9, shown in FIG. 3, is then placed around the lower edge 7C, to lock the ball securely into the coupling device 7.

The force adjustment means 3 in this second embodiment comprises a plurality of weights that are slidably mounted on the first end 2C of the support means 2. Individual weights are removed from the support means as the training program progresses.

There are many suitable methods of securing the force-adjusting means 3 to a specific position. Providing a series of holes in the support means and using a snap button that snaps into one of the holes is one method. Providing a series of holes in both the support means and force-adjusting means, matching a hole in the force-adjusting means to one in the support means to obtain the desired length, and using a pin to couple the two parts together is another simple method. There are many conventional types of couplings that are suitable for this purpose and they are not described herein in any detail.

Figure 11:
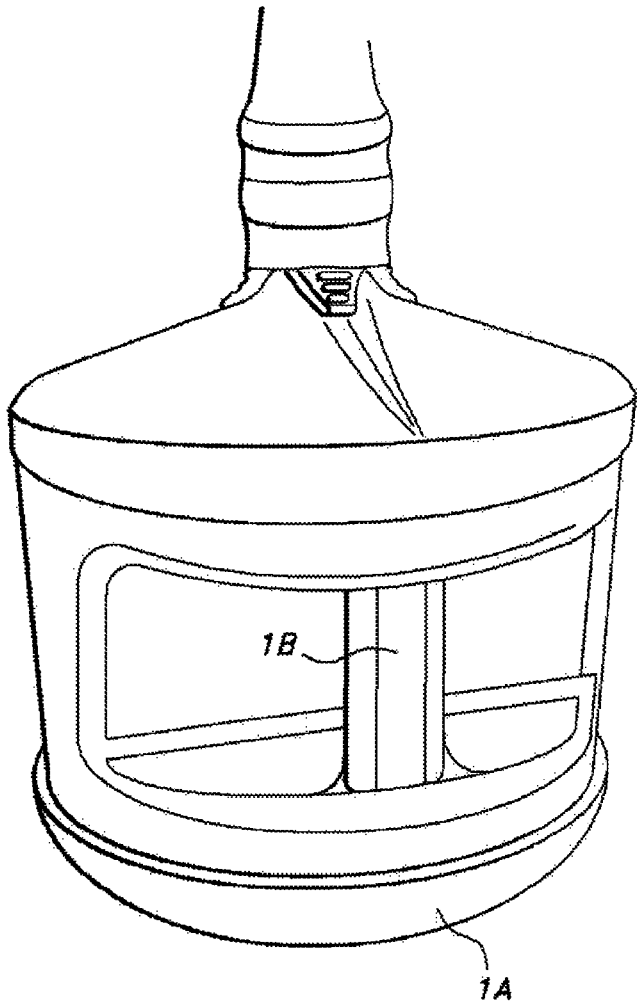
FIG. 11 shows details of the base.

An anti-slip pad 1A may be provided on the bottom of the base 1 to prevent the base from slipping. Also, a handle 1B may be incorporated into the base as shown in FIG. 11.

Figure 7:
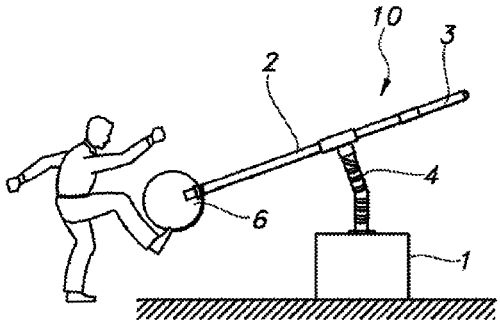
FIG. 7 illustrates a user juggling a soccer ball.
Figure 8:
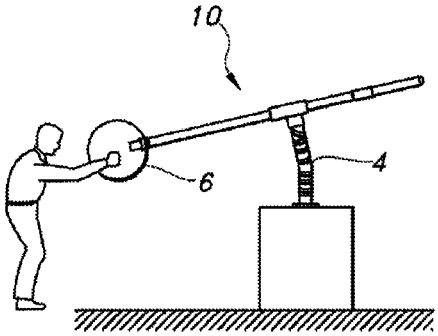
FIG. 8 illustrates a user hitting a volleyball.
Figure 9:
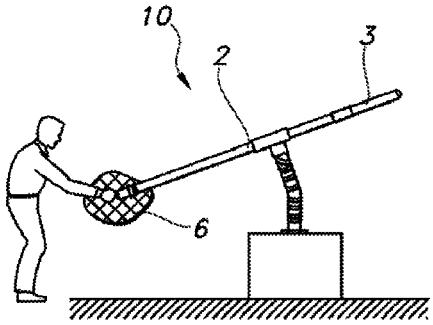
FIG. 9 illustrates a user using a racket to hit a tennis ball.
Figure 10:
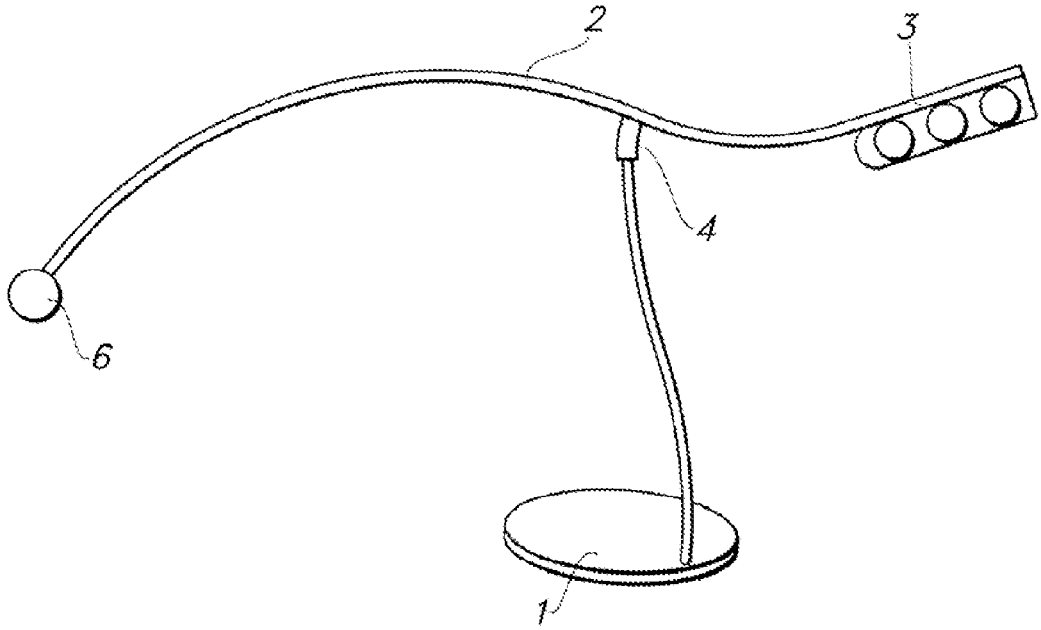
FIG. 10 illustrates the variable gravity training device for training skills in hitting a golf ball.

FIGS. 7-10 illustrate various applications for the training device 10 according to the invention. These illustrations are merely representative of various sports activities that can be trained with the training device and are in no way limiting. FIG. 7 illustrates a person using the training device 10 according to the invention to train for soccer. The weighted base 1 is heavy enough that it does not move when the ball is kicked. The ball is brought back to the same position relative to the base, i.e., back to the same spot on the ground. The user may kick the ball upward and, as it returns, use other parts of the body, for example, a knee, to engage the ball again, as illustrated. Other foreseeable applications for the training device 1 include training for volleyball, basketball, tennis. FIG. 8 illustrates a person training for volleyball; FIG. 9 a person training for tennis; and FIG. 10 illustrates a golf training device. Other uses include using the training device to practice crunches in strength training, or as a strike zone for practicing fencing or boxing, or also for physical therapy. In the illustrations, only a single user is shown working with the training device 10. It is also possible to have multiple users use the training device to practice maneuvers that involve 360-degree rotation.

FIGS. 1-6 and 10 illustrate several embodiments of the variable gravity training device 10 according to the invention. A person of skill in the art will recognize that the stationary base 1 may have many structural variations, because its only purpose is to provide a secure anchor for the support means 2. Examples of a suitable structure for the stationary base include, but are not limited to, an adjustable vertical pole that is mounted to a wall or between the floor and ceiling of a structure; a horizontal bar mounted in a doorway; an anchor, such as a tent stake, that is driven into the ground; or any stationary structure that will serve as a secure anchor means for the support means. The embodiment also shows the flexible connector 4 mounted on a mounting base 5 that is affixed to the stationary base 1. This is due to the specific construction of the weighted base in that particular embodiment, which requires that the top of the base be reinforced to provide a secure and solid connector base for the flexible connector. This mounting base may not be necessary with other embodiments of the stationary base 1.

It is, of course, also possible to use any number of connectors for the flexible connector 4. The spring in the first embodiment and the flexible body in the second embodiment are mechanically simple devices that are easy to affix to the various structural elements that can conceivably be used for the stationary base and the support means. It is understood, however, that other types of connectors may be well suited to provide the flexible connector, such as, but not limited to, ball joints, universal joints, ball bearings, roller bearings, taper bearings, etc. Essentially, any connector can be used that supports the support means and that also pivots or flexes in a way that allows the support means to deflect appropriately when the sports device is engaged.

It is understood that the embodiments described herein are merely illustrative of the present invention. Variations in the construction of the training device may be contemplated by one skilled in the art without limiting the intended scope of the invention herein disclosed and as defined by the following claims.

What is claimed is:

1. A variable gravity training device comprising a stationary base having an inlet opening leading into a hollow inner space for receiving a weighting material;

a support means for supporting a sports device attached to an end of the support means;

a multi-directional flexible connector for mounting the support means to the stationary base, the multi-directional flexible having a first end affixable to the inlet opening of the stationary base and a second end affixable to the support means;

a sports device that is attached to the support means; and a force-adjusting means that is coupled to the support means, the force-adjusting means enabling adjustment of a force required to move the sports device and the speed with which the sports device falls back to a home position; and a coupling device for removably coupling the sports device with the support means, the coupling device being a pre-formed hollow body adapted to retain the sports device and having a coupling tube that extends from the hollow body for coupling with the support means;

wherein, when no external force is applied to the sports device or support means, the multi-directional flexible connector supports the support device in a home position and, when an external force is applied to the sports device or support means, the multi-directional flexible connector flexes, so as to allow the sports device to travel in a direction of the applied external force and return to the home position.

2. The variable gravity training device of claim 1, wherein the support means is a tube with a first end and a second end, and wherein the sports device is attached to the first end and the force adjustment means attached to the second end.

3. The variable gravity training device of claim 1, wherein the force adjustment means comprises a plurality of weights that are removably mounted on the support means.

4. The variable gravity training device of claim 1, wherein the force adjustment means is an extension bar that is slidably held in the support means.

5. The variable gravity training device of claim 1, wherein the multi-directional flexible connector is a spring helical coil spring.

6. The variable gravity training device of claim 1, wherein the multi-directional flexible connector is a molded body.

7. The variable gravity training device of claim 1, wherein the hollow body is a partial sphere in shape, with an open lower edge that is flexible in diameter and adaptable for receiving the sports device.

8. The variable gravity training device of claim 7, further comprising a retainer band that fits around the open lower edge to secure the body to the sports device.

9. The variable gravity training device of claim 8, wherein the retainer band is an elastic band.

10. The variable gravity training device of claim 1, wherein the first end of the multi-directional flexible connector is formed as an open tube with spaced-apart extensions provided around a circumference of the open tube, such that, when the open tube is fitted over the inlet opening, the extensions splay outward against an upper surface of the stationary base.

11. The variable gravity training device of claim 1, wherein the second end of the multi-directional flexible connector includes a threaded bore, a contoured surface formed above the threaded bore, and a threaded fastener, the contoured surface being adapted to seat the support means, and wherein the support means has a through-bore dimensioned to accommodate the threaded fastener, such that, when the support means is seated in the contoured surface, the threaded fastener is insertable through the through-bore and the contoured surface and into the threaded bore.

* * * * *